United States Patent [19]

Woods et al.

[11] Patent Number: 4,872,322

[45] Date of Patent: Oct. 10, 1989

[54] POWER OPERATED CONTACT APPARATUS FOR SUPERCONDUCTIVE CIRCUIT

[75] Inventors: Daniel C. Woods, Florence, S.C.; Kenneth R. Efferson, Oak Ridge, Tenn.

[73] Assignee: General Electric Company, Milwaukee, Wis.

[21] Appl. No.: 239,811

[22] Filed: Sep. 2, 1988

[51] Int. Cl.[4] ..... F25B 19/00

[52] U.S. Cl. ..... 62/51.1; 335/216; 361/19; 361/141

[58] Field of Search ..... 62/514 R; 361/19, 141; 335/216; 339/112 R

[56] References Cited

U.S. PATENT DOCUMENTS

| | | | |
|---|---|---|---|
| 4,510,758 | 4/1985 | Tench, Jr. | 62/514 R |
| 4,516,404 | 5/1985 | Laskaris | 62/514 R |
| 4,526,015 | 7/1985 | Laskaris | 62/514 |
| 4,544,979 | 10/1985 | Ennis, Jr. et al. | 361/19 |
| 4,614,393 | 9/1986 | Laskaris | 339/95 |
| 4,635,450 | 1/1987 | Laskaris | 62/514 |
| 4,635,451 | 1/1987 | Laskaris | 62/514 R |
| 4,694,663 | 9/1987 | Miller | 62/514 R |
| 4,702,825 | 10/1987 | Selvaggi et al. | 62/514 R |

OTHER PUBLICATIONS

GE Medical Systems GE Magnet & Cryogens Subsystem Handbook, Rev. 3, Direction 15093, pp. 6-5, 6-6, 6-7 and 2-2.

*Primary Examiner*—Ronald C. Capossela

*Attorney, Agent, or Firm*—Quarles & Brady

[57] ABSTRACT

A power operated contact apparatus extends and retracts one or more electrical leads into and out of a cryostat for making and breaking, at a cryogenic temperature, electrical contacts with a superconductive circuit. A pair of rigid elongated leads extend into a cold space of the cryostat which is at or near a cryogenic temperature. A connector is fixed at the inner end of each lead for making electrical contact in the cold space with a mating connector of the superconductive circuit. A guide journals each lead for axial movement and seals against the leading using an elastomeric O-ring coated with a lubricious polymer. A foundation is attached and sealed to the cryostat and to the guide means so that the connector on the inner end of the lead is extendable into making electrical contact with the connector of the superconductive circuit in the cold space. An air cylinder operated four bar linkage extends and retracts the leads to and from making electrical contact wiht the superconductive circuit in the cold space. The leads are cooled by flowing cryogen from the cryostat through them, which flow is turned off when they are disconnected, and prevented from freezing up outside of the cryostat by a flow of air directed around the leads.

9 Claims, 6 Drawing Sheets

POWER OPERATED CONTACT APPARATUS FOR SUPERCONDUCTIVE CIRCUIT

BACKGROUND OF THE INVENTION

1. Field of the Invention

The field of the invention is electrical contact apparatus for energizing and deenergizing a superconductive circuit and, in particular, such apparatus having leads which are automatically extended and retracted to make and break contacts with the circuit at a cryogenic temperature.

2. Discussion

Magnetic resonance (MR) magnets are well known for diagnostic imaging purposes. These magnets typically include a superconductive magnet coil assembly which is immersed in liquid helium to reduce the temperature of the coil assembly to being at or below the critical temperature at which the coil assembly enters the superconductive state. In the superconductive state, the coil has an electrical resistance of zero ohms so that it can conduct a very large "persistent" current. The current generates a correspondingly high magnetic field which is used for the diagnostic imaging purposes.

Such MR magnets may be stationed in a special room therefor or may be part of a mobile system in which the magnet is transported in a truck or van to different locations where it is used. Magnets which produce less intense magnetic fields (e.g. less than 0.5 Tesla) may be constructed so as to substantially contain the magnetic field in the volume of interest by using magnetic shields. However, a shield for a more powerful magnet (e.g. 1.5 Tesla) would be too heavy to transport and therefore it is not practical to shield such a magnet. Rather, the more powerful magnets are deenergized prior to transport, transported in the deenergized state, and then reenergized or ramped at the location of use. For less powerful magnets and magnets which are installed in buildings, energizing and de-energizing the magnet is infrequent and may only occur once in the life of the magnet.

For the powerful, transportable magnets, recharging and discharging may occur two or more times per day depending upon the number of locations to be serviced on any given day. Thus, it is often necessary on the powerful, portable magnets to make and break connections with the magnet coil to energize and de-energize the magnet. The connections are usually made and broken deep inside the cryostat at the cryogenic temperature. A penetration tube of the cryostat provides access to the terminals on the superconducting magnet. Such penetration tubes are discussed in patents such as U.S. Pat. No. 4,526,015. Such penetration tubes generally penetrate the cryostat through one or more vacuum or other insulating layers, and into the helium vessel in which the magnet coils and liquid helium are contained at or somewhat above atmospheric pressure. Such penetration tubes may be either vertical, horizontal or could be at some other orientation. Making and breaking the connections at the cryogenic temperature minimizes vaporization of the liquid helium inside the cryostat because after the magnet is energized, the leads can be retracted out of thermally conductive contact with the superconducting circuit and out of the space which is at or near the cryogenic temperature to minimize heat transfer through the leads to the cold space.

For most MR magnets, the connections with the main magnet coil for energizing and de-energizing the magnet have been made manually. However, this is cumbersome for the powerful, portable magnets for which such connections may be made quite often. Also, in the van or truck in which such magnets are transported, the space around the cryostat for access to the penetration tube can be very limited, which hampers manual connection.

The penetration tube contains helium vapor and it is desirable to seal the top of the penetration tube to a pressure slightly above atmospheric (e.g., 1.5 psig) to conserve helium. A recondenser provides refrigeration of the cold space to make up for heat losses and maintain the pressure in the operating range. In the invention, a sliding seal is provided between the leads and the top of the penetration tube. However, because it is necessary to cool the leads by circulating helium through them when they are energizing the magnet, and also because the leads are made of metal, which is a good thermal conductor, it has been found that, when energizing the magnet coil, the leads have a tendency to freeze up and become bound to the top of the penetration tube such that they cannot be retracted.

SUMMARY OF THE INVENTION

One aspect of this invention is in providing a power operated contact apparatus for extending and retracting one or more electrical leads into and out of a cryostat for making and breaking, at a cryogenic temperature, electrical contact with a superconductive circuit to eliminate manually making and breaking the connections with the magnet terminals. At least one rigid elongated lead is provided for extending into a cold space of the cryostat which is at or near a cryogenic temperature. A connector is fixed at the inner end of the lead for making electrical contact in the cold space with a connector of the superconductive circuit. A guide journals the lead for allowing the lead to move axially relative to the guide means and sealing against the lead. A foundation is attached and sealed to the cryostat and to the guide means so that the connector on the inner end of the lead is extendable into making electrical contact with the connector of the superconductive circuit in the cold space Power operated means mounted on the foundation extends and retracts the lead to and from making electrical contact with the superconductive circuit in the cold space. Thereby, an alternative to making manual connections with the superconducting circuit is provided.

In a preferred form, the power operated means includes a four bar linkage having upper joints, lower joints, and side joints A power operated cylinder has a cylinder housing which is connected to one of the side joints of the linkage and a piston rod which is connected to the other side joint of the linkage. Extension of the piston rod causes the leads to retract and retraction of the piston rod causes the leads to extend. With this mechanism, the stroke for extending and retracting the leads into and out of the cryostat is provided with minimal access space necessary outside of the cryostat.

In another aspect, a sliding seal is provided between the guide means and the leads by a composite O-ring seal having a core ring made of an elastomer. The core ring has a coating of a permanent lubricious material. Preferably, the core ring is silicone rubber and the coating is polytetraflouroethylene. The elastomer core remains resilient at extremely low temperatures while the lubricious coating reduces the coefficient of friction between the O-ring and the leads to facilitate sliding.

In another aspect, means for de-icing the leads when the leads are connected to the superconducting circuit are provided. The de-icing means includes heating means for warming the leads where they extend out of the guide means and air abrasion means. In a preferred form, the de-icing means includes a collar surrounding the lead above the guide means and a stream of air is admitted to the interior of the collar around the outside of the lead for warming the lead and abrading the initial formation of any ice on the lead. This prevents humidity in the ambient air around the lead from condensing and freezing on the lead which may otherwise bind the lead to the guide means.

In another aspect, upper and lower orifi are provided to conduct a flow of cryogen through the leads to cool them when they are connected. A valve is connected to the upper orifice to automatically turn off the flow of cryogen through the leads when they are disconnected to conserve the cryogen inside the cryostat.

It is therefore a principal object of the invention to provide a power operated apparatus for making and breaking electrical contacts at a cryogenic temperature with a superconducting circuit.

It is another object of the invention to provide such an apparatus which is economical to manufacture and operate.

It is another object of the invention to provide such an apparatus which can provide a sliding seal at extremely low temperatures.

It is another object of the invention to provide such an apparatus which prevents freezing up during operation.

It is another object of the invention to provide such an apparatus which provides for satisfactory cooling of leads but also conserves cryogen.

These and other objects of the invention will be apparent from the drawings and from the detailed description.

DETAILED DESCRIPTION OF THE PREFERRED EMBODIMENT

Figure 1:
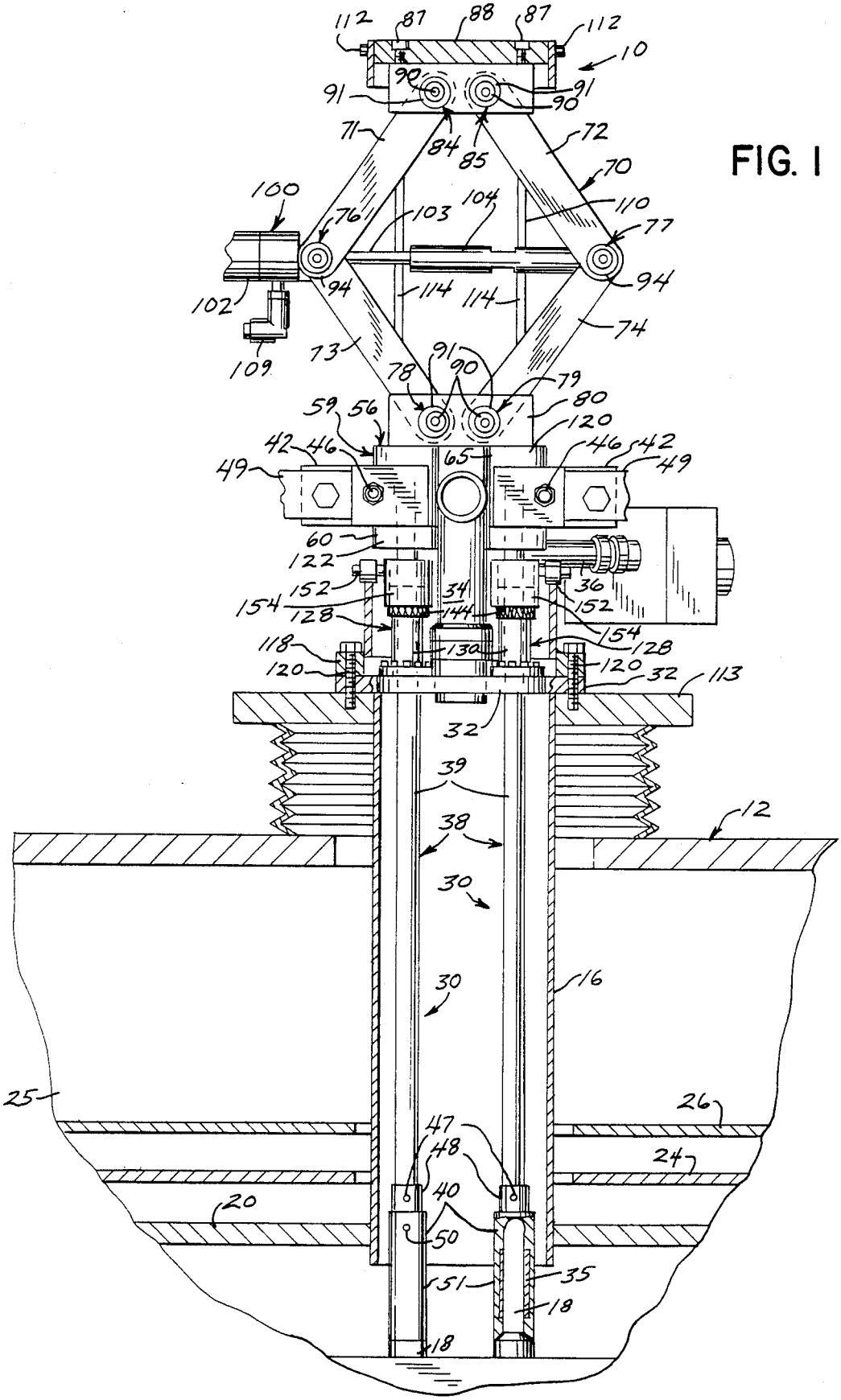
FIG. 1 is a sectional view of an apparatus of the invention shown mounted on a cryostat (illustrated schematically) and in a connected position with the leads extended in contact with a superconducting circuit.

Referring to FIG. 1, a power operated contact apparatus 10 of the present invention is shown mounted at the top of a cryostat 12, shown schematically, which houses a superconducting magnet circuit (not shown). A penetration tube 16 extends from the top of the cryostat 12 down through the insulating layers of the cryostat 12 to terminals 18 of the superconductive magnet circuit.

The cryostat 12 may be of any suitable construction. Briefly, the cryostat 12 is a thermally insulating container made up of several hollow cylindrical toroids which are nested one within another. The innermost hollow cylindrical toroid 20 contains a helium bath in which the superconducting magnet circuit is immersed. The innermost toroid 20 or helium vessel is sealed from the remaining interior of the outermost toroid 22 by the bottom of the penetration tube 16 being welded or otherwise sealed to the top of the helium vessel 20. The interior space 25 of the toroid 22 (other than the helium vessel 20 and the penetration tube 16) contains a vacuum to minimize thermal heat transfer. Contained within the vacuum and around the helium vessel are two thermal heat shields 24 and 26 to minimize radiation heat transfer losses. Thus it can be seen that the helium vessel 20 and penetration tube 16 define a contiguous space and that the penetration tube 16 is in general registration with the terminals 18.

In practice, the helium vessel 20 is filled with liquid helium to a level below the terminals 18 although helium vapor at a temperature which is nearly that of the helium liquid (e.g., if the helium liquid is at 4.2° K., the vapor may be 4.4° K.) rises above the terminals 18 and into the penetration tube 16 which cools the terminals 18 and wear portion of the penetration tube 16 to a cryogenic temperature. Hereafter, this portion and any area within approximately four inches above the terminals 18 will be referred to as the cold space.

The power operated contact apparatus 10 includes two leads 30 for making and breaking electrical contact with the terminals 18 of the superconducting magnet circuit. These leads 30 extend through a base plate 32 and are guided therein for vertical movement in the penetration tube 16 toward and away from the terminals 18. Also extending through the base plate 32 are a recondenser stinger 34 and a conduit 36. The recondenser stinger 34, although not shown to its full extent, extends down into the penetration tube 16 into the cold space near the terminals 18. The end of the recondenser stinger 34 which is in the cold space is cooled by external refrigeration means (not shown) to a temperature slightly below that of the vapor (e.g., if the vapor is at 4.4° K., the recondenser stinger is cooled to approximately 4.2° K.) so that helium vapor coming in contact with the end of the recondenser stinger 34 condenses and returns as liquid helium to the helium vessel. Thus, the recondenser is for the purpose of conserving liquid helium and allows a low pressure sealed system. Recondensers per se are well known.

The conduit 36 is for routing wires for magnet shim coils which also reside in the helium vessel along with the main superconducting magnet circuit. The purpose of the shim coils is well known in magnetic resonance imaging and need not be explained here. Briefly, the shim coils produce magnetic fields which correct for inhomogeneities in the main magnetic field produced by the main superconducting magnet coil. Thus, the conduit 36 would extend all the way down to the vicinity of the terminals 18 (although not fully shown) and the wires contained in the conduit would extend into the helium vessel 20 to make contact with the shim coils. Connector 33 enables making connections externally with the shim coils. The shim coil leads routed through the conduit 36 are hard wired to the shim coils or wired with semi-permanent connectors (rather than being retractable like the main coil leads 30) inside the cryostat because they are so numerous and small in comparison with the main coil leads that the amount of heat they conduct into the cold space does not warrant retraction.

Figure 2:
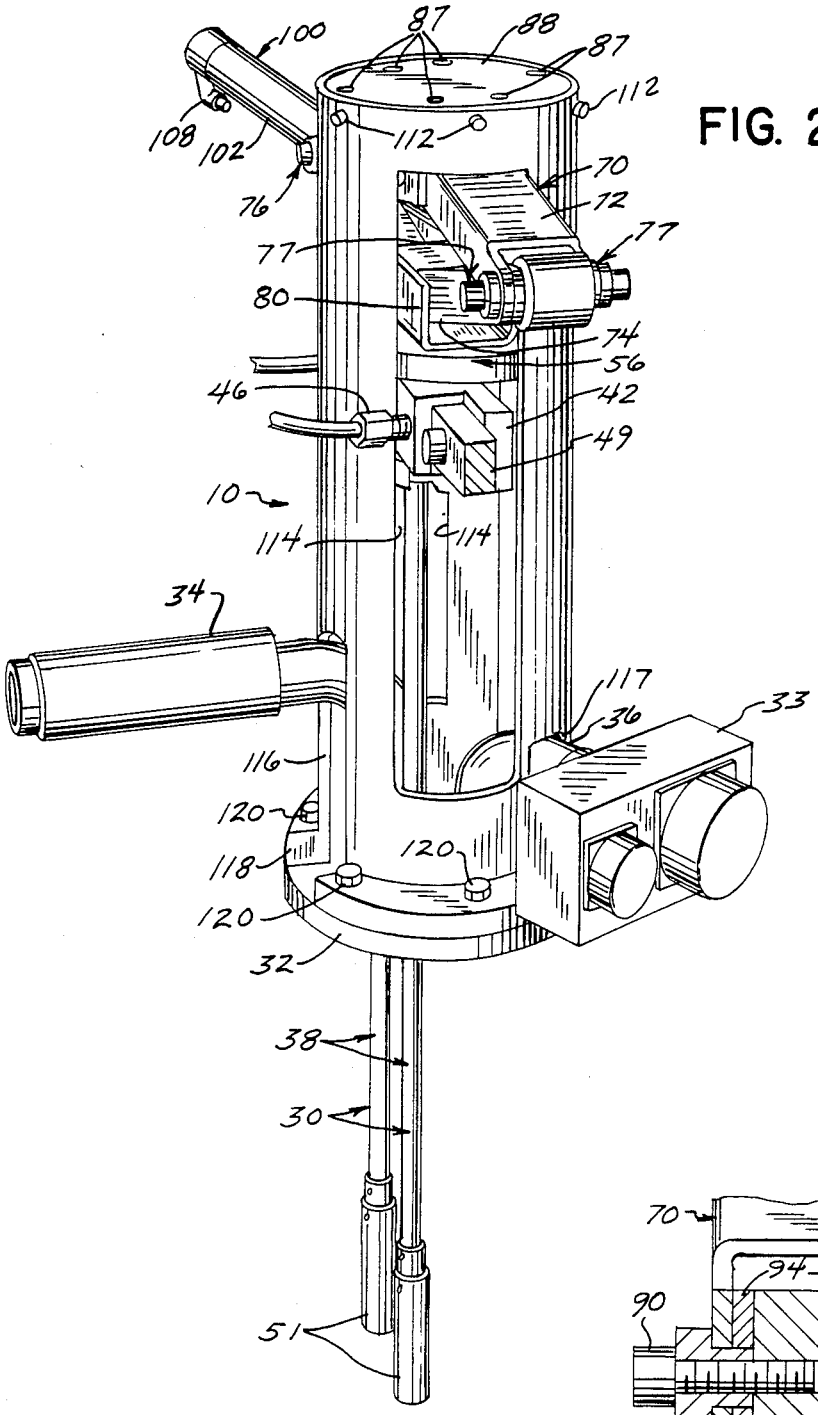
FIG. 2 is a perspective view of the apparatus of FIG. 1.
Figure 3:
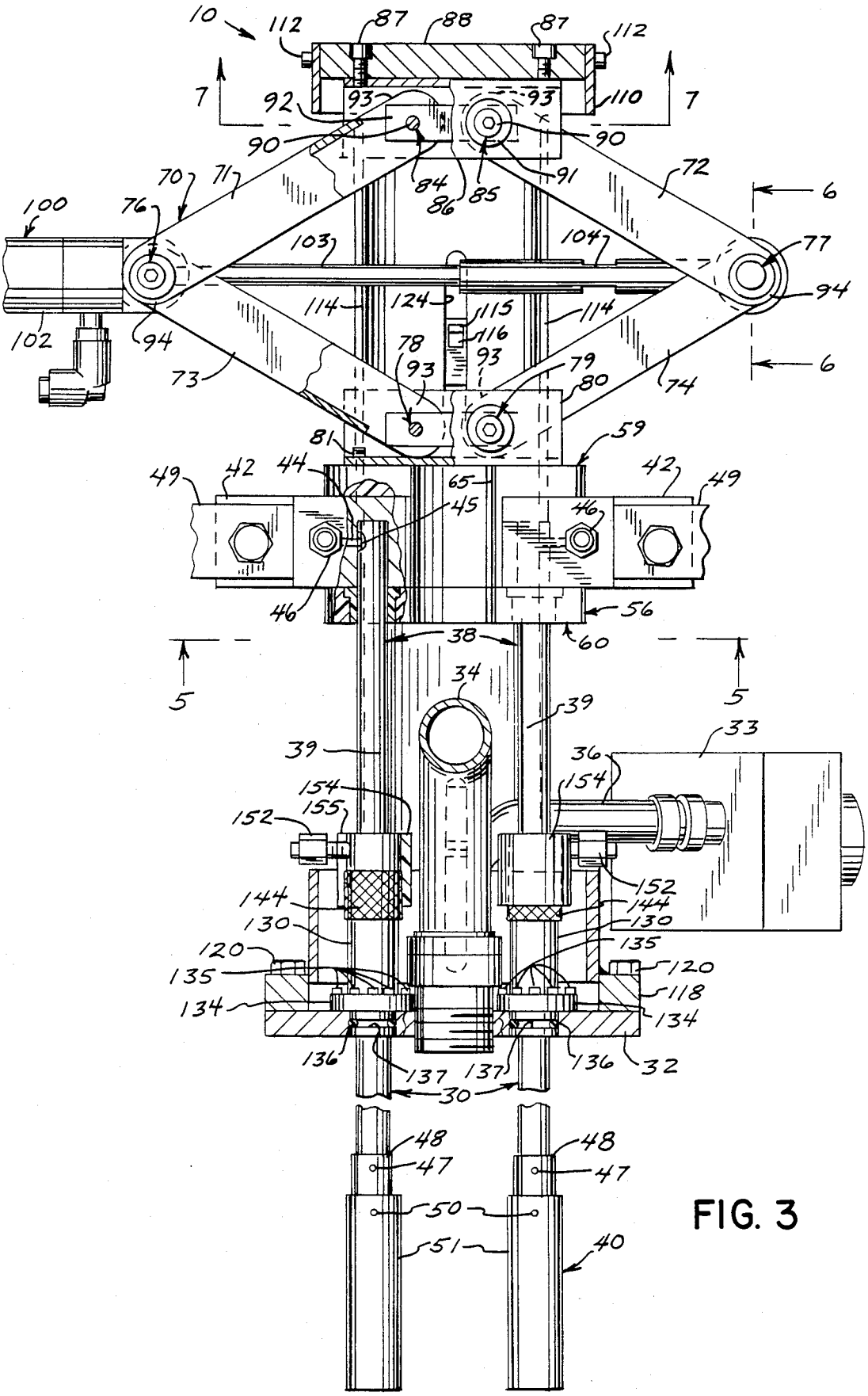
FIG. 3 is a detail sectional view from the front of the apparatus.
Figure 4:
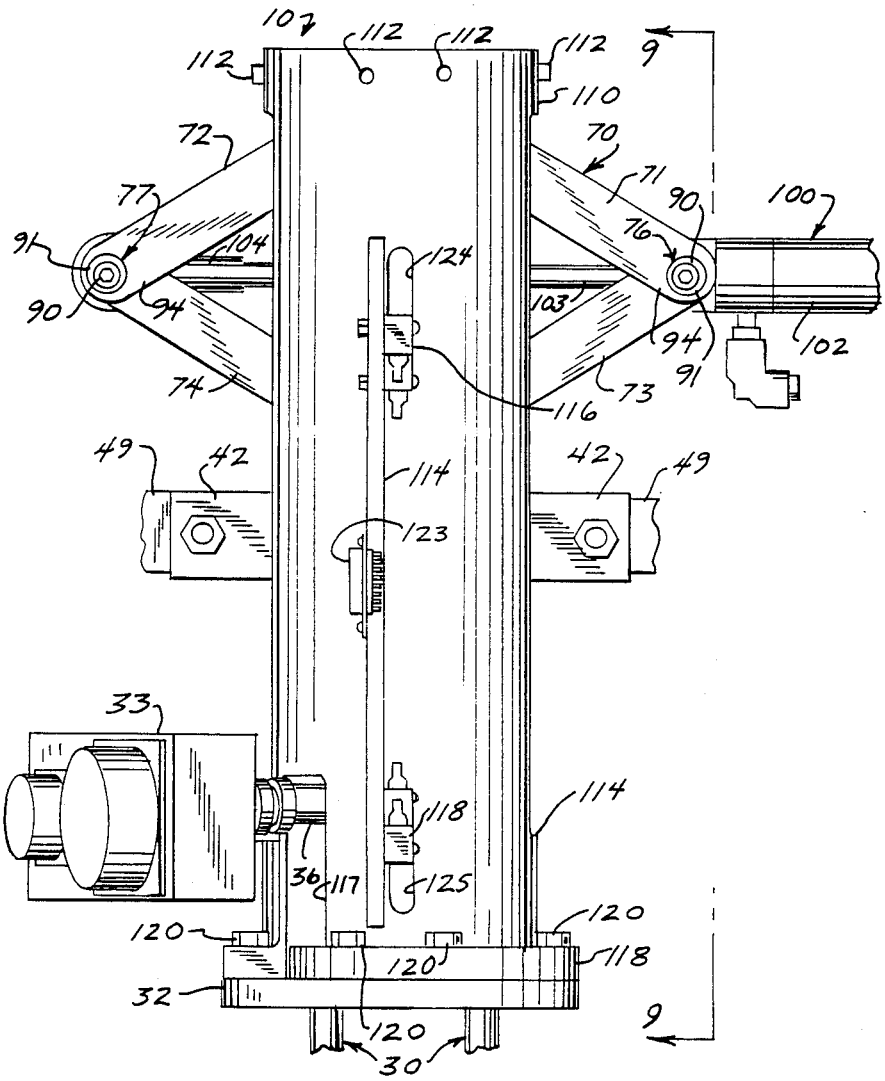
FIG. 4 is a rear plan view of the apparatus.
Figure 10:
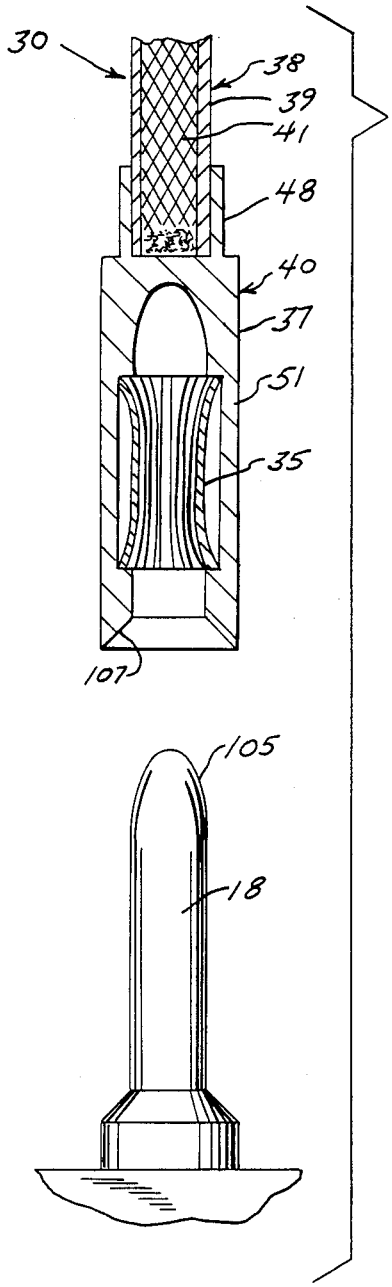
FIG. 10 is a sectional view of a connector for the apparatus.

Referring to FIGS. 2, 3 and 10, each lead 30 includes a conductor 38 having a connector 40 soldered at the lower end thereof. The conductor 38 is of well known construction including a tubular housing 39 and braided copper wires 41 inside the housing 39. The connector 40 includes a housing 37 and a resilient contact band 35. The conductor 38 and connector 40 are capable of conducting a high current (e.g., a one-half inch diameter conductor is capable of up to more than 780 amps) to the terminals 18. The particular conductors 38 of the preferred embodiment are commercially available as model no. L-750S from American Magnetics, Inc., Oak Ridge, Tenn., and the preferred connectors 40 are available as part no. 10456 from Hugin Industries, Los Altos, Calif.

The top of each conductor 38 is soldered in a copper bus bar connector 42 (FIG. 3) which has terminal studs 43 for attachment to cables 49 for supplying electrical current to the leads 30. Passages 44 and 45 in the bus bar 42 communicate with tubing quick connects 46 which are screwed into the bus bar 42. A small orifice 47 in an upper portion 48 of the connector 40 admits helium vapor to the interior of the conductor 38 to cool the conductor 38 during operation. The helium gas is then exhausted out through the quick connects 46. The tubular conductors 38, as mentioned above, have internal braided copper wires 41 which allow a flow of helium up through the conductor 38. In the preferred embodiment, the flow rate is adjusted using one or more valves (not shown) to be approximately 8–10 liquid liters/hour to keep the leads sufficiently cool. The braided copper wires 41 inside the conductors 38 are in electrical communication by means of the solder joints previously mentioned at the upper and lower ends with the bus bars 42 and the connectors 40, respectively. An orifice 50 in a lower portion 51 of each connector 40 provides an exhaust for helium vapor which enters the bottom of the connector 40 to cool the connector 40 and mated terminal 18 during operation.

Figure 5:
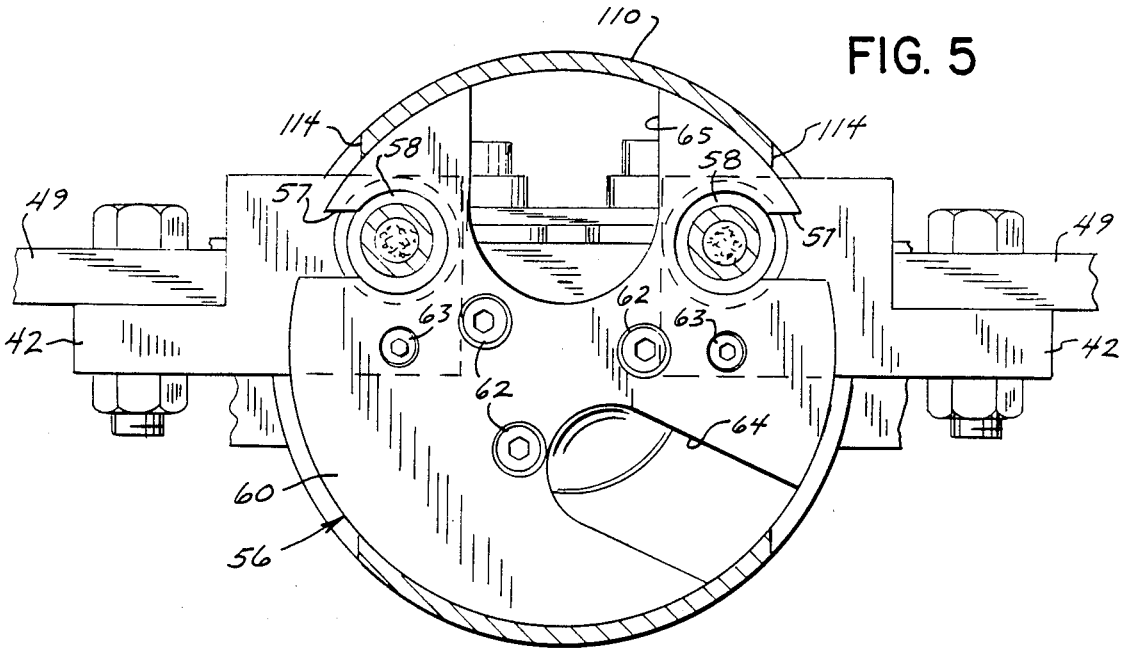
FIG. 5 is a sectional view of the apparatus taken from the plane of the line 5—5 of FIG. 3.

Referring to FIGS. 3 and 5, the leads 30 are fixed to a phenolic piston 56. Keyhole shaped slots 57 are formed in a lower portion 60 of the piston 56 and phenolic spacers 58 fit the leads 30 in the round part of each slot 57. This construction allows different sized leads, for different current capacities, to be adapted for use with the piston 56. The bus bars 42 are sandwiched between the lower portions 60 and upper portions 59 of the phenolic piston 56. Cap screws 62 join the upper and lower portions 59 and 60 of the piston 56 and cap screws 63 fasten the bus bars 42 to the piston 56. A slot 64 is formed in the piston 56 to clear the conduit 36 and another slot 65 is formed in the piston 56 to clear the recondenser stinger 34.

An air cylinder operated four bar linkage 70 provides for powered reciprocation of the piston 56 and therefore of the leads 30 into and out of contact with the terminals 18. The four bar linkage 70 has upper links 71 and 72 which are pivotally joined to lower links 73 and 74 by side joints 76 and 77. The lower ends of the lower links 73 and 74 are pivotally joined by lower joints 78 and 79 to a lower clevis 80 which is secured to the piston 56 by suitable fasteners 81 (FIG. 3). The upper ends of the upper links 71 and 72 are similarly pivotally mounted by joints 84 and 85 to an upper clevis 86 which is secured by suitable fasteners 87 to a cap plate 88.

Figure 7:
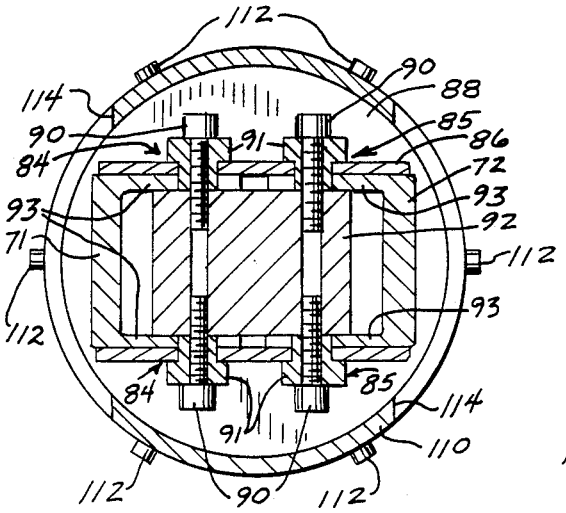
FIG. 7 is a sectional view of the apparatus taken from the plane of the line 7—7 of FIG. 3.
Figure 9:
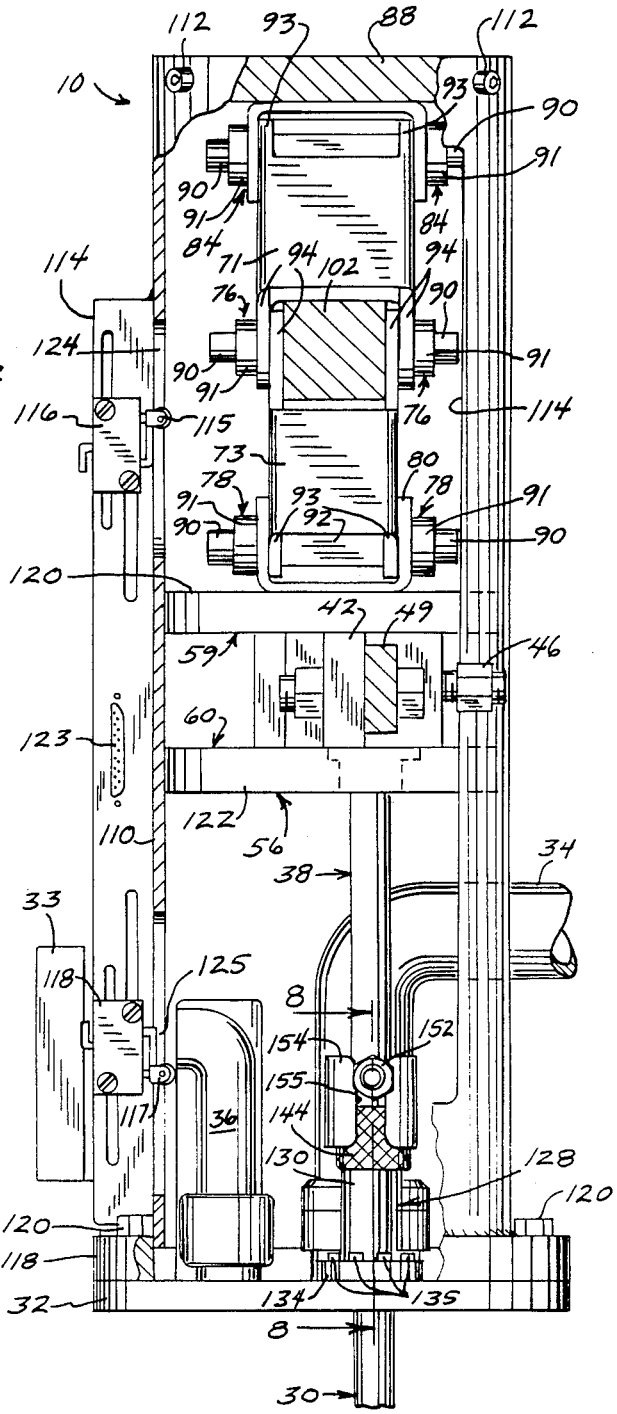
FIG. 9 is a sectional view of the apparatus taken from the plane of the line 9—9 of FIG. 4.

The links 71–74 may all be made of aluminum formed in a channel shape, as may the clevises 80 and 86, although the parts should be of different widths so they can nest within each other at the joints. The lower joints 78 and 79 and the upper joints 84 and 85 are similarly constructed and the upper joints 84 and 85 are best shown in FIG. 7. These joints are made by inserting screws 90 into opposite sides of the joint through shouldered bushings 91 and threading the screws into a spacer block 92. The smaller diameter of the bushings 91 extends through the clevis 86 side walls and through ears 93 at the ends of the upper links 71 and 72, and seat against the spacer block 92 when the screws 90 are tightened against the bushings 91. This prevents sandwiching in compression the links 71 and 72 between the clevis 86 and the spacer block 92 to produce freely pivotable joints.

Figure 6:
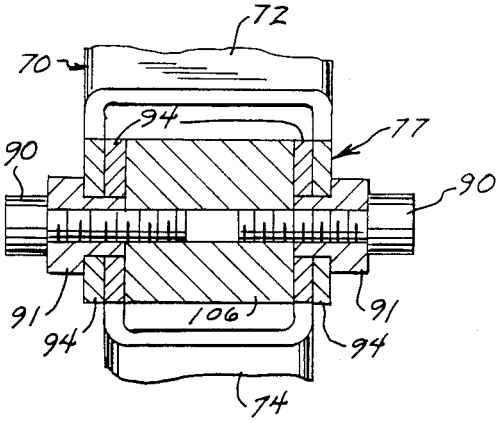
FIG. 6 is a sectional view of a side joint of the apparatus taken from the plane of the line 6—6 of FIG. 3.

A power actuator 100 comprises a conventional air operated cylinder 102 (1" diameter) having a piston rod 103. The air operated cylinder is pivotally fixed to side joint 76 and the piston rod 103 is secured to a connector rod 104 which is pivotally secured to side joint 77. The side joints 76 and 77 are similar, and side joint 76 is best shown in FIG. 6. The joint of FIG. 6 has opposing screws 90 which extend through shouldered bushings 91 and ears 94 of upper and lower links 72 and 74, respectively, and which are threaded into a spacer block 106. As with the upper joints 84 and 85, the screws 90 tighten against the bushings 91, which seat against the spacer blocks 106 to produce a freely pivotable joint.

The air cylinder 102 has ports 108 and 109 (FIGS. 1 and 2) for applying pressure to one side or the other of the piston in the cylinder to extend or retract the piston rod 103. Applying pressure to port 108 while exhausting port 109 extends the piston rod 103, which, through the four bar linkage 70, retracts the leads 30 to break contact with the terminals 18 and move the leads 30 into an upper, disconnected position which is out of the cold space. Applying pressure to port 109 while exhausting port 108 retracts the piston rod 103, which extends the leads 30 down into the cold space to make contact with the terminals 18 in a connected position. The stroke of the air cylinder 102 in the preferred embodiment is six inches, and that is also the stroke of the leads 30. As the leads 30 are reciprocated, the cylinder 102 also moves vertically as well as horizontally, along with the joint 76.

An advantage of the four bar linkage 70 is that it allows the leads 30 to be self-aligning with the terminals 18. As is apparent from FIG. 10, the terminals 18 have external tapered surfaces 105 and the connectors 40 have internal tapered surfaces 107 which tend to align each connector 40/terminal 18 pair as the connectors 40 are lowered onto the terminals 18. This self aligning is made possible because the rectilinear motion imparted to the leads 30 by the linkage 70 is not rigid. Rather, the linkage imparts a substantially vertical reciprocating motion to the leads, but also allows the leads to pivot about the upper 84 and 85 and lower 78 and 79 joints, and also move and rotate transversely somewhat relative to said joints, to the extent permitted by guides 128, which allows the leads enough play to correct minor misalignments with the terminals 18.

The cap plate 88 is fixed at the top of a frame 110 by screws 112. The frame 110 is generally tubular and has windows 114 which provide for clearance of the four bar linkage 70 and of the bus bar connectors 42. Slots 116 and 117 at the bottom of the frame 110 provide space for entry of the recondenser stinger 34 and conduit 36, respectively. A flange 118 at the bottom of the frame 110 has a standard bolt hole pattern, as does the base plate 32, so that the frame 110 and base plate 32 may be fastened to a standard mounting pad 113 at the top of the penetration tube 16 using bolts 120. The overall height of the apparatus 10 above the mounting pad 113 is only about 14.5 inches, and the diameter of the frame 110 is approximately 4 inches.

An optional switch plate 114 is welded to the side of the frame 110. The plate 114 mounts upper 116 and lower 118 limit switches. When the linkage 70 is in the disconnected or retracted position shown in FIG. 2, flange 120 of the upper portion 59 of the phenolic piston 56 trips actuator 115 of the upper limit switch 116. When the linkage 70 is in the extended or connected position shown in FIG. 1, flange 122 of the lower portion 60 of the phenolic piston 56 trips actuator 117 of the lower switch 118. Thus, these switches 116 and 118 sense whether the linkage 70 is in the open or closed position and the signals produced by the switches 116 and 118 may be used in any suitable manner for sensing the position of the linkage 70, for example, for feedback and control in an automatic ramping sequence for an MR magnet. A connector 123 or other suitable electronic components may also be mounted on the plate 114. Slots 124 and 125 are provided in the frame 110 to provide access for actuators 115 and 117 of the switches 116 and 118 to be tripped by the piston 56.

The recondenser stinger 34 and conduit 36 are stationary relative to the base plate 32 and the joints between the recondenser 34, the conduit 36 and the base plate 32 are sealed such as by using threaded connections. The leads 30, on the other hand, are axially slidable through the base plate 32. A guide 128 is provided for each lead 30 to make the sliding connection and is seated in a bore 133 (see FIG. 8) of the base plate 32. Each guide 128 has a guide housing 130, made of fiberglass, plastic or other suitable electrically insulating material, which has a flange 134 is fastened to the base plate 32 by suitable fasteners 135 (FIG. 3). An O-ring 136 in a groove 137 of a lower portion of each guide housing 130 provides a stationary seal between each guide 128 and the base plate 32. Thus, there can be no leakage of gaseous helium at operating pressure (10–20 psig) through the joints between the guides 128 and the base plate 32.

Figure 8:
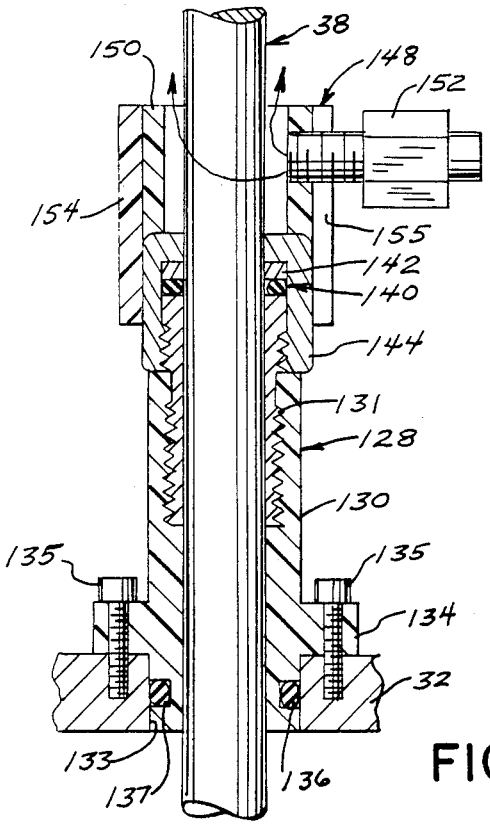
FIG. 8 is a sectional view of a guide for the apparatus taken from the plane of the line 8—8 of FIG. 9.
Figure 12:
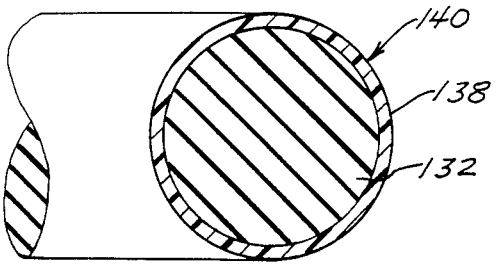
FIG. 12 is a sectional view of an O-ring for the guide of the apparatus.

Referring to FIG. 8, each guide 128 also includes a brass sleeve 131, for providing a bearing surface, which is screwed into each guide housing 130. The inside diameters of the sleeve 131 and guide housing 130 are slightly larger than the outside diameter of the conductor 38 so that there is a sliding fit between the conductor 38 and the sleeve 131 and guide housing 130. An O-ring 140 made of a core ring 132 (FIG. 12) of an elastomer, such as silicone rubber, coated with a permanent film 138 of a lubricious polymer such as polytetraflouroethylene, surrounds the conductor 38 at the top of the sleeve 131 to seal against the conductor 38 in a sliding seal. A pressure ring 142 fits closely around the conductor 38 and is pressed against the top of the O-ring 140 to squash the O-ring 140 against the top of the sleeve 131, and thereby produce a tighter seal against the conductor 38. The pressure is exerted against the top of the pressure ring 142 by a knurled cap 144 which is threaded down onto the sleeve 131.

The coated O-ring 140 is particularly well suited in this application. The elastomer interior of the O-ring 140 maintains sufficient resiliency even at extremely low temperatures which can occur in the O-ring in this construction. The low temperatures occur during ramping and discharge when the assembly is in the connected position. Heat is conducted into the magnet when the leads 30 are inserted into the cold space and particularly when contact is made with the terminals 18 which correspondingly cools the leads to an extremely low temperature. Also, as previously explained, helium gas flows from the cold space up through each lead 30 and is then exhausted through the quick connects 46. This also makes the area around the guides 128 extremely cold. Thus, the elastomer imparts sufficient resiliency to the O-rings 140, while the lubricious polymer coating lowers the coefficient of friction between each O-ring 140 and conductor 38 to provide a sliding fit for reciprocation of the conductor 38 relative to the guide 128. No leakage of helium vapor is allowed past the joint between the O-ring 140 and the conductor 38 and guide 128 at the operating pressure. Polytetraflouroethylene encapsulated silicon rubber O-rings like that used are commercially available from Row Incorporated, Chicago, Ill. and an assembly including the sleeve 131, an O-ring 140, pressure ring 142 and cap 144 are available from A&N Corporation, Inglis, Fla., as a "vacuum coupling", vendor part no. 50-KM It has been found that the leads 30 outside of the cryostat above the guides 128 get so cold when the assembly is in the extended or connected position that water vapor and possibly air in the ambient atmosphere outside of and around the guides 128 condenses on the conductors 38 and guides 128 and freezes thereon. The ice so formed can bind a conductor 38 to the corresponding guide 128 such that it is very difficult to move them relative to one another. To alleviate this problem, de-icer means 148 is provided. The de-icer 148 includes a loose fitting ring 150 around the conductor 38 at the top of the corresponding guide 128. A standard tubing connector 152 is threaded into the side of the ring 150 and is connected to a source of compressed air for blowing air into the ring and around the space between the ring 150 and conductor 38 just above the guide 128. A resilient band 154 clamps the cap 144 to hold the ring 150 on top of the guide 128 and has a slot 155 to accommodate the connector 152. In the extended or connected position of the assembly 10, the bottom of the piston 56 is only about a quarter of an inch above the ring 150 so that air is blown against the sides of the conductor 38 and the bottom of the piston 56 to also prevent the formation of ice thereon. The compressed air stream serves to warm the conductor 38 and other parts against which it blows and also to abrade the parts of any initial formation of ice. In the preferred embodiment, the air is delivered at a pressure of about 80 psig and a combined flow rate for both leads 30 of approximately 3.5 scfm. Presently, the flow rate is constant whether the leads 30 are connected to the terminals 18 or not. However, it may be possible in some applications to shut the flow off when the leads 30 are in their retracted, disconnected position.

Figure 11:
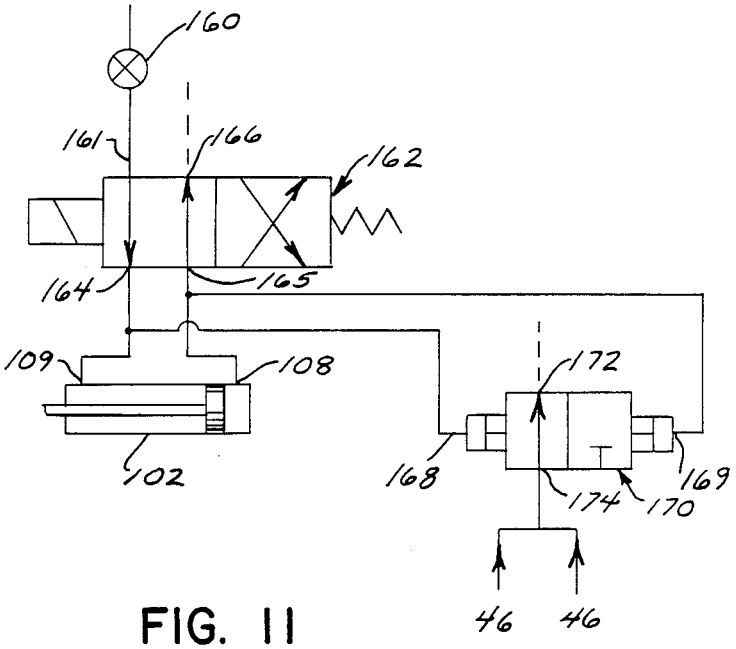
FIG. 11 is a schematic air circuit for the apparatus.

Referring to FIG. 11, a schematic air circuit for the power operated leads 10 is disclosed. An air source 160 delivers air at approximately 80 psig to port 161 of a two position, four way solenoid operated spring return valve 162. Port 164 of the valve 162 is connected to port 109 of air cylinder 102 and port 165 of valve 162 is connected to port 108 of cylinder 102. Port 166 of valve 162 is connected to exhaust. Ports 164 and 165 are also connected to opposite sides 168 and 169, respectively, of a two way two position pressure operated valve 170. Port 172 of valve 170 is connected to exhaust and port 174 of valve 170 is connected to the quick connects 46, so that the helium flowing through the leads 30 is exhausted through the valve 170.

The circuit of FIG. 11 operates as follows. When the leads 30 are to be connected to the terminals 18, valve 162 is electrically actuated using any suitable self holding switch or control circuit and power supply (not shown). This shifts valve 162 into the position schematically shown in FIG. 11 to provide pressure to port 109 of cylinder 102 and thereby extend the leads 30 to connect with terminals 18. Pressure is also supplied to port 168, and exhaust is connected to port 169, to shift valve 170 into the position shown in FIG. 11, which allows helium gas to exhaust through the leads 30. When ramping of the magnet circuit is complete, or for some other reason disconnection is desired, the solenoid valve 162 is deenergized and thereby shifted to connect ports 161 and 165 and ports 164 and 166. This pressurizes ports 108 and 169 and connects ports 109 and 168 to exhaust, which disconnects the leads 30 from the terminals 18 and shuts off the flow of helium through the leads 30 to reseal the cryostat 12. It should be noted that limit switches (not shown) could also be used to sense the position of the pressure operated valve 170 to insure that it is in position for helium to flow through the leads 30 before current is applied to the leads.

Many modifications and variations of the preferred embodiment will be apparent to those of ordinary skill in the art but will still be within the spirit and scope of the invention. Therefore, the invention should not be limited by the scope of the preferred embodiment, but only by the claims which follow.

We claim:

1. A power operated contact apparatus for extending and retracting one or more electrical leads into and out of a cryostat for making and breaking, at a cryogenic temperature, electrical contact with a superconductive circuit, comprising:

at least one rigid elongated lead for extending into a cold space of the cryostat which is at or near a cryogenic temperature, said lead having an inner end and a outer end;

a connector fixed at the inner end of the lead for making electrical contact in the cold space with a connector of the superconductive circuit;

guide means journaling said lead for allowing said lead to move axially relative to the guide means and sealing against said lead;

a foundation for sealed attachment to the cryostat and to the guide means so that the connector on the inner end of the lead is extendable into making electrical contact with the connector of the superconductive circuit in the cold space;

power operated means mounted on the foundation and fixed to the outer end of the lead for extending and retracting the lead to and from making electrical contact with the superconductive circuit in the cold space; and means for de-icing the exterior of the leads and guide means when the leads are connected to the superconducting circuit.

2. An apparatus as in claim 1, wherein the power operated means includes a four bar linkage having upper joints, lower joints, and side joints, and a power operated cylinder having a cylinder housing which is connected to one of the side joints of the linkage and a piston rod which is connected to the other side joint of the linkage, wherein extension of the piston rod causes the leads to retract and retraction of the piston rod causes the leads to extend.

3. An apparatus as in claim 1, wherein a sliding seal is provided between the guide means and the leads by a composite O-ring seal having a core ring made of an elastomer, said core ring having a coating of a permanent lubricious material.

4. An apparatus as in claim 3, wherein the core of the O-ring is silicone rubber and the coating is polytetraflouroethylene.

5. An apparatus as in claim 1, wherein the de-icing means includes heating means for warming the leads where they extend out of the guide means.

6. An apparatus as in claim 1, wherein the de-icing means includes air abrasion means.

7. An apparatus as in claim 1, wherein the de-icing means includes a collar surrounding the lead outside of the guide means, and means for admitting a stream of air to the interior of the collar around the outside of the lead for warming the lead and abrading the initial formation of any ice on the lead.

8. An apparatus as in claim 7, wherein the collar is mounted on the guide means.

9. An apparatus as in claim 1, further comprising upper and lower orifice means for conducting a flow of cryogen from inside the cryostat through the leads and out of the cryostat when the leads are connected to the superconducting circuit to cool the leads, and power operated valve means connected to the upper orifice for turning off the flow of cryogen through the leads when the leads are disconnected.

* * * * *